US011970669B2

(12) United States Patent
Tohyama et al.

(10) Patent No.: US 11,970,669 B2
(45) Date of Patent: Apr. 30, 2024

(54) LUBRICANT, LUBRICATING COMPOSITION, AND SLIDING MACHINE

(71) Applicant: KABUSHIKI KAISHA TOYOTA CHUO KENKYUSHO, Nagakute (JP)

(72) Inventors: Mamoru Tohyama, Nagakute (JP); Hiroshi Moritani, Nagakute (JP); Shigeru Hotta, Nagakute (JP); Norikazu Sato, Nagakute (JP); Hisato Takeuchi, Nagakute (JP); Yoshihiro Kikuzawa, Nagakute (JP); Tomoyuki Kinjo, Nagakute (JP)

(73) Assignee: KABUSHIKI KAISHA TOYOTA CHUO KENKYUSHO, Nagakute (JP)

( * ) Notice: Subject to any disclaimer, the term of this patent is extended or adjusted under 35 U.S.C. 154(b) by 0 days.

(21) Appl. No.: 18/160,672

(22) Filed: Jan. 27, 2023

(65) Prior Publication Data

US 2023/0365883 A1 Nov. 16, 2023

(30) Foreign Application Priority Data

May 16, 2022 (JP) ..... 2022-079876

(51) Int. Cl.
*C10M 105/58* (2006.01)
*C10N 20/00* (2006.01)

(52) U.S. Cl.
CPC .... *C10M 105/58* (2013.01); *C10M 2215/023* (2013.01); *C10N 2020/065* (2020.05)

(58) Field of Classification Search
CPC ..... C10M 105/58; C10M 133/06; C10M 2203/1025; C10M 2215/04; C10M 2215/023; C10N 2020/02; C10N 2020/065; C10N 2040/25; C10N 2040/04; C10N 2030/06
See application file for complete search history.

(56) References Cited

U.S. PATENT DOCUMENTS 5,073,280 A * 12/1991 Rossio ..... C10M 133/06 508/412
2004/0214733 A1 10/2004 Baba
2015/0110963 A1* 4/2015 Jiang ..... C23F 11/149 106/14.42

FOREIGN PATENT DOCUMENTS

JP 2002-338983 A 11/2002
JP 2022-024803 A 2/2022
WO WO-2011062282 A1 * 5/2011 ..... C10M 133/06

* cited by examiner

*Primary Examiner* — Vishal V Vasisth
(74) *Attorney, Agent, or Firm* — Oliff PLC

(57) ABSTRACT

[Technical Problem] An object is to provide a lubricant capable of forming a stable adsorption film on a sliding surface and stabilizing the sliding characteristics (for example, ensuring the wear resistance, etc.).

[Solution to Problem] The present invention provides a lubricant represented by the following chemical structural formula.

[Chemical Formula 1]

Formula (1)

(R: a hydrocarbon group whose carbon number is 8 to 24, m and n: integers of 2 to 8) [Selected Figure] FIG. 5A

6 Claims, 8 Drawing Sheets

| Name of compound | Used amount | | Maker |
|---|---|---|---|
| (1) Oleylamine (Raw material) | 11.38 g | (42.5 mmol) | Aldrich |
| (2) N-(4-Bromobutyl)phthalimide | 24.00 g | (85.1 mmol) | TCI |
| (3) $NaHCO_3$ | 7.15 g | (85.1 mmol) | Wako |
| (4) DMF (dehydrated) | 114 mL | | Cica |

| Name of compound | Used amount | | Maker |
|---|---|---|---|
| (1) Oleylamine (Raw material) | 11.38 g | (42.5 mmol) | Aldrich |
| (2) N-(4-Bromobutyl)phthalimide | 24.00 g | (85.1 mmol) | TCI |
| (3) $NaHCO_3$ | 7.15 g | (85.1 mmol) | Wako |
| (4) DMF (dehydrated) | 114 mL | | Cica |

| Name of compound | Used amount | | Maker |
|---|---|---|---|
| (1) Bisphthalimide product | 13.77 g | (20.6 mmol) | Synthesized product |
| (2) $N_2H_4 \cdot H_2O$ | 10.29 g | (205.5 mmol) | Wako |
| (3) EtOH | 275 mL | | GODO |
| (4) THF | 275 mL | | Wako |

FIG. 7

≪Normalized with $C_2H_5^+$ around m/z 29.04≫

| Sample | Total ion intensity | $^{29}C_2H_5$ intensity | $^{30}CH_4N$ | $^{43}C_2H_5N$ | $^{56}Fe$ | $^{56}C_3H_6N$ | $^{70}C_4H_8N$ | $^{72}C_4H_{10}N$ | $^{84}C_5H_{10}N$ | $^{110}C_7H_{12}N$ | $^{145}HO_2Fe_2$ | $^{268}C_{18}H_{38}N$ | m/z:323 | m/z:349 |
|---|---|---|---|---|---|---|---|---|---|---|---|---|---|---|
| C1 | 1674576 | 53668 | 1.20E+00 | 1.21E-01 | 2.47E+00 | 4.37E-01 | 2.16E-01 | 8.76E-02 | 9.50E-02 | 3.81E-02 | 9.43E-02 | 1.59E-02 | 1.55E-03 | 1.34E-03 |
| 1 | 1264461 | 26540 | 2.43E+00 | 3.24E-01 | 2.10E+00 | 8.67E-01 | 1.67E+00 | 1.16E+00 | 8.91E-01 | 3.08E-01 | 4.80E-02 | 3.69E-03 | 2.35E-02 | 3.89E-02 |

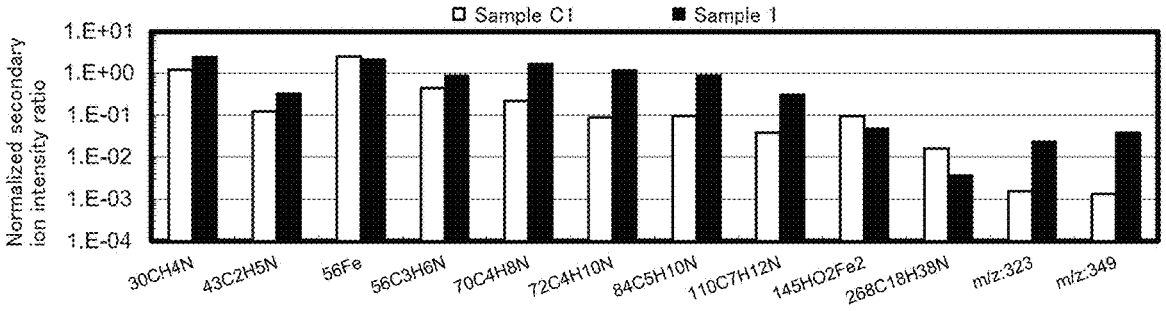

≪Normalized with $C_2H_3^+$ around m/z 27.02≫

| Sample | Total ion intensity | $^{27}C_2H_3$ intensity | $^{30}CH_4N$ | $^{43}C_2H_5N$ | $^{56}Fe$ | $^{56}C_3H_6N$ | $^{70}C_4H_8N$ | $^{72}C_4H_{10}N$ | $^{84}C_5H_{10}N$ | $^{110}C_7H_{12}N$ | $^{145}HO_2Fe_2$ | $^{268}C_{18}H_{38}N$ | m/z:323 | m/z:349 |
|---|---|---|---|---|---|---|---|---|---|---|---|---|---|---|
| C1 | 1674576 | 37778 | 1.70E+00 | 1.72E-01 | 3.51E+00 | 6.21E-01 | 3.08E-01 | 1.24E-01 | 1.35E-01 | 5.42E-02 | 1.34E-01 | 2.26E-02 | 2.20E-03 | 1.91E-03 |
| 1 | 1264461 | 16816 | 3.83E+00 | 5.12E-01 | 3.32E+00 | 1.37E+00 | 2.63E+00 | 1.84E+00 | 1.41E+00 | 4.86E-01 | 7.58E-02 | 5.83E-03 | 3.71E-02 | 6.14E-02 |

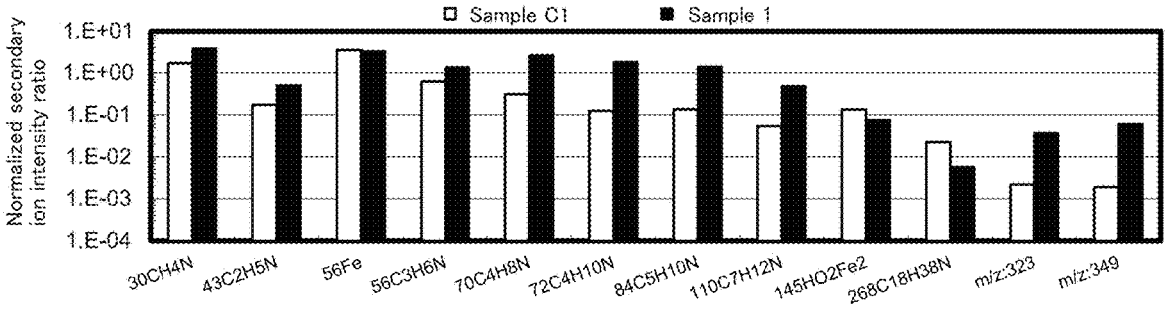

≪Normalized with total ion amount≫

| Sample | Total ion intensity | $^{30}CH_4N$ | $^{43}C_2H_5N$ | $^{56}Fe$ | $^{56}C_3H_6N$ | $^{70}C_4H_8N$ | $^{72}C_4H_{10}N$ | $^{84}C_5H_{10}N$ | $^{110}C_7H_{12}N$ | $^{145}HO_2Fe_2$ | $^{268}C_{18}H_{38}N$ | m/z:323 | m/z:349 |
|---|---|---|---|---|---|---|---|---|---|---|---|---|---|
| C1 | 1674576 | 3.84E-02 | 3.89E-03 | 7.92E-02 | 1.40E-02 | 6.94E-03 | 2.81E-03 | 3.04E-03 | 1.22E-03 | 3.02E-03 | 5.10E-04 | 4.96E-05 | 4.30E-05 |
| 1 | 1264461 | 5.10E-02 | 6.81E-03 | 4.41E-02 | 1.82E-02 | 3.50E-02 | 2.44E-02 | 1.87E-02 | 6.46E-03 | 1.01E-03 | 7.75E-05 | 4.93E-04 | 8.17E-04 |

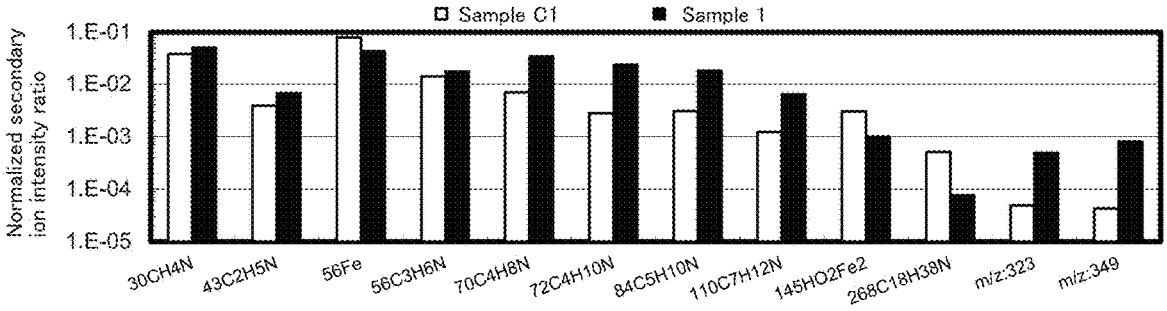

LUBRICANT, LUBRICATING COMPOSITION, AND SLIDING MACHINE

TECHNICAL FIELD

The present invention relates to a lubricant and relevant techniques.

BACKGROUND ART

In machines having sliding portions, a longer operating life, reduced losses (improved efficiency), etc. are achieved by reducing the wear and friction. Such sliding characteristics are greatly affected by lubricants (including compositions such as lubricating oil) supplied to (interposed between) the sliding portions. Accordingly, many proposals regarding lubricants and the like have been made, and relevant descriptions are found, for example, in the following patent documents.

PRIOR ART DOCUMENTS

Patent Documents

[Patent Document 1] JP2002-338983A
[Patent Document 2] JP2022-24803A

SUMMARY OF INVENTION

Technical Problem

Patent Document 1 proposes a lubricating composition excellent in the anticorrosion performance. Patent Document 2 proposes a lubricating composition for diesel engines having desired viscosity.

These patent documents do not include any description or suggestion relating to the adsorptivity of the lubricating composition on a sliding surface, a film formed on the sliding surface, or the like.

The present invention has been made in view of such circumstances, and an object of the present invention is to provide a novel lubricant and relevant techniques capable of stabilizing the sliding characteristics.

Solution to Problem

As a result of intensive studies to achieve the above object, the present inventors have developed a lubricant having a novel structure with excellent adsorptivity to a sliding surface. Developing this achievement, the present inventors have accomplished the present invention, which will be described below.

«Lubricant»

(1) The present invention provides a lubricant represented by the following chemical structural formula.

[Chemical Formula 1]

Formula (1)

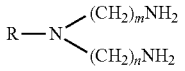

(R: A Hydrocarbon Group Whose Carbon Number is 8 to 24, m and n: Integers of 2 to 8)

(2) When the lubricant of the present invention is used in a sliding machine or the like, a stable adsorption film can be formed on a sliding surface, and stabilization of the sliding characteristics and the like are achieved.

The reason and mechanism that the lubricant of the present invention develops such excellent effects are not necessarily clear, but the present understandings are as follows. As represented by the chemical structural formula (1), the lubricant of the present invention includes two aminoalkyl groups. These functional groups allow the lubricant of the present invention to adsorb to the surface of a base material (e.g., steel material) more stably than conventional ones. As a result, when the lubricant or its composition of the present invention is supplied to the sliding portions (between the sliding surfaces) of a sliding machine, a strong adsorption film is quickly formed on at least one of the sliding surfaces (for example, immediately after starting the operation of the sliding machine), and the desired sliding characteristics (such as wear resistance and low friction) can be stably ensured.

«Lubricating Composition»

The present invention is also perceived as a lubricating composition that contains the above-described lubricant. The lubricating composition may be, for example, a liquid phase (mixed liquid) that contains the lubricant or a solid phase (composite material) in which the lubricant is dispersed. A typical example of the lubricating composition is a lubricating oil obtained by adding the lubricant to a base oil.

«Sliding Machine»

The present invention is also perceived as a sliding machine having a sliding surface to which the above-described lubricant is supplied. The lubricant is supplied to the sliding surface, for example, as a lubricating oil. Typical examples of the sliding machine include engines and transmissions, and the lubricant is supplied to the sliding surface as an additive for engine oil or transmission oil (including automatic transmission fluid (ATF)).

«Others»

(1) The hydrocarbon groups R and R' as referred to in the present specification may be saturated groups or unsaturated groups and may be linear groups or branched groups.

(2) Unless otherwise stated, a numerical range "x to y" as referred to in the present specification includes the lower limit x and the upper limit y. Any numerical value included in various numerical values or numerical ranges described in the present specification may be selected or extracted as a new lower or upper limit, and any numerical range such as "a to b" can thereby be newly provided using such a new lower or upper limit. Unless otherwise stated, a range "x to y ppm" as referred to in the present specification means x ppm to y ppm. The same applies to other unit systems.

BRIEF DESCRIPTION OF DRAWINGS

FIG. 7 is a set of tables and bar graphs illustrating normalized values of peak areas obtained by TOF-SIMS.

EMBODIMENTS FOR CARRYING OUT THE INVENTION

Figure 1A:
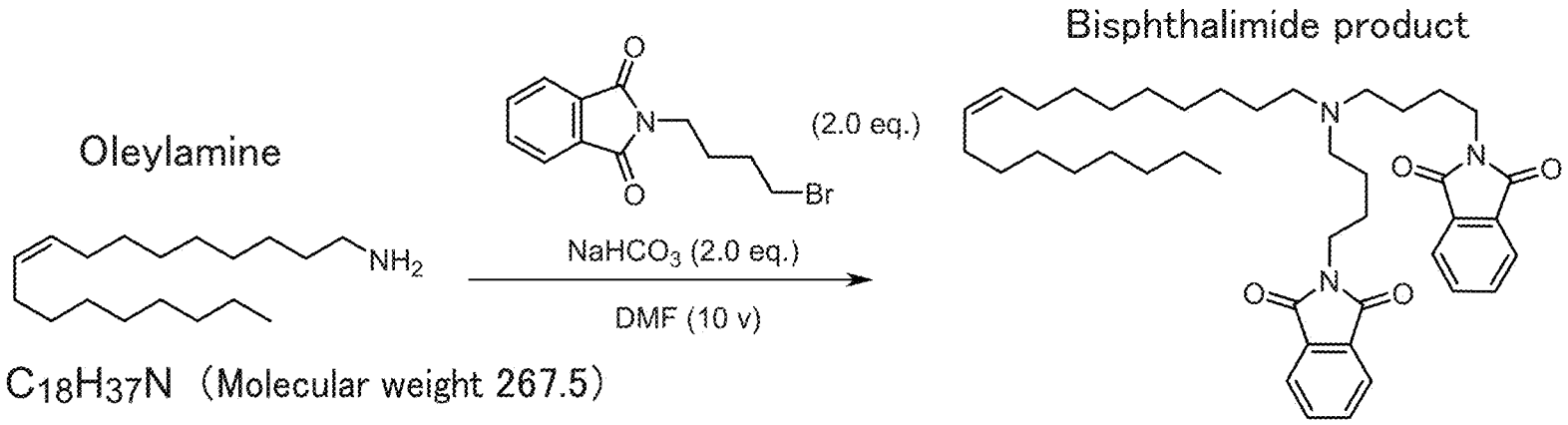
FIG. 1A is an explanatory diagram illustrating a first synthesis step for a lubricant (one example).

One or more features freely selected from the present specification can be added to the above-described features of the present invention. The content described in the present specification can apply not only to lubricants or lubricating compositions, but also to sliding machines, sliding members, etc. Features relating to a production method can also be features relating to a product. Which embodiment is the best or not is different in accordance with objectives, required performance, and other factors.

«Lubricant»

The lubricant is composed of molecules represented by the chemical structural formula (1). The R that constitutes the main chain of the molecule is a hydrocarbon group whose carbon number is 8 to 24 in an embodiment, 12 to 22 in another embodiment, or 16 to 20 in still another embodiment. The hydrocarbon group may be a saturated hydrocarbon group or an unsaturated hydrocarbon group. Examples of the hydrocarbon group constituting the main chain include alkyl groups such as oleyl, 2-ethylhexyl, n-octyl, isooctyl, nonyl, decyl, undecyl, dodecyl, lauryl, tridecyl, pentadecyl, hexadecyl, palmitoleyl, heptadecyl, octadecyl, stearyl, linoleyl, nonadecyl, tetradecyl, and arachidyl groups and unsaturated alkyl groups (alkenyl groups).

The two functional groups (alkylamines) in the chemical structural formula (1) may have the same carbon number or different carbon numbers. In general, when the carbon number is the same (m=n), synthesis of the lubricant is facilitated.

When the molecules represented by the chemical structural formula (1) are analyzed, for example, by proton nuclear magnetic resonance spectroscopy ('H-NMR), chemical shift values of spectra representing $H_a$ and $H_b$ indicated in the following chemical structural formula (2) can be around 2.4 ppm and 2.6 ppm, respectively. Note that R is equal to R' ($CH_2$), and the carbon number of R' is (the carbon number of R−1).

[Chemical Formula 2]

Formula (2)

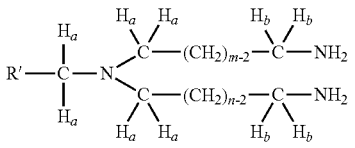

«Organic Film»

An organic film derived from the lubricant can be formed on a sliding surface supplied with the lubricant. This organic film may be formed only of the molecules represented by the chemical structural formula (1), or may also be generated so that the molecules react with surrounding molecules (e.g., constituent molecules of a base oil). The generation mechanism is not clear, but it is conceivable that the two functional groups (alkylamines) in the lubricant molecule strongly and quickly adsorb to the sliding surface (base material surface), thus forming the organic film excellent in the sliding characteristics.

The presence or absence of an organic film can be determined based on a profile (positions and sizes of spectra) obtained by positive ion spectrum analysis with time-of-flight secondary ion mass spectrometry (TOF-SIMS) on a sliding surface that has been in contact with a lubricant. The detection sensitivity (peak intensity/peak area) by TOF-SIMS is likely to vary from sample to sample. The intensity (reference area) of a specific peak obtained for each sample is used as a reference to evaluate the intensity (area) of another peak (i.e., to normalize the intensity (area) of another peak with the reference area), thereby enabling quantitative analysis of an organic film.

An example of such a reference peak is the peak around m/z 29.04 ($C_2H_5^+$). With reference to its peak area ($S_0$/reference area), in an organic film, a peak area ($S_1$) around m/z 30.03 ($CH_4N^+$) can be, for example, 1.5 times or more ($S_1/S_0 \geq 1.5$) in an embodiment or twice or more in another embodiment, a peak area ($S_2$) around m/z 70.07 ($C_4H_8N^+$) can be 0.3 times or more ($S_2/S_0 \geq 0.3$) in an embodiment or once or more in another embodiment, and a peak area ($S_3$) around m/z 84.08 ($C_5H_{10}N^+$) can be 0.1 times or more ($S_3/S_0 \geq 0.1$) in an embodiment or 0.5 times or more in another embodiment.

Additionally or alternatively to such peaks, for example, a peak area ($S_4$) around m/z 323.32 or a peak area ($S_5$) around m/z 349.35 may be 0.01 times or more ($S_4/S_0 \geq 0.01$, $S_5/S_0 \geq 0.01$) in an embodiment or 0.02 times or more in another embodiment. Specific molecular structures of the positive ions detected around m/z 323.32 or m/z 349.35 are unknown, but they are determined to be composed of an organic substance that does not contain a metal element, because their mass numbers after the decimal point (0.32 and 0.35) are values on the positive side with respect to the integer values (323 and 349).

Additionally or alternatively to the peak area around m/z 29.04 ($C_2H_5^+$), the peak area around m/z 27.02 ($C_2H_3^+$) or the total area of peaks (total amount of ions) may be used as a reference. Suffice it to say that the peak area around m/z 29.04 ($C_2H_5^+$) is adopted as the reference area because the peak around m/z 29.04 is larger than the peak around m/z 27.02 in the samples analyzed this time.

«Lubricating Composition/Sliding Machine»

Lubricating compositions include, for example, engine oils and transmission oils (including ATF) in which lubricants are added to base oils. Sliding machines include, for example, engines and transmissions. The lubricant of the present invention can quickly form an organic adsorption film on the sliding surface and is therefore suitable also for low-viscosity lubricating compositions and sliding machines that are operated in a low-temperature region (e.g., transmissions, internal combustion engines dedicated for hybrid vehicles, etc.).

The compounding amount of the lubricant can be adjusted as appropriate. For example, the lubricant is added to the entire lubricating composition at 0.001 to 10 mass % in an embodiment, 0.01 to 5 mass % in another embodiment, or around 0.1 to 3 mass % in still another embodiment. The lubricating composition may contain a plurality of types of molecules that belong to the chemical structural formula (1) (molecules having different carbon numbers (molecular weights) or structures (including isomers)). The lubricating composition may contain one or more additives or the like other than the lubricant of the present invention.

EXAMPLES

The present invention will be described in more detail while presenting specific examples regarding lubricants and the like.

«Lubricant»

(1) Synthesis

Figure 1B:
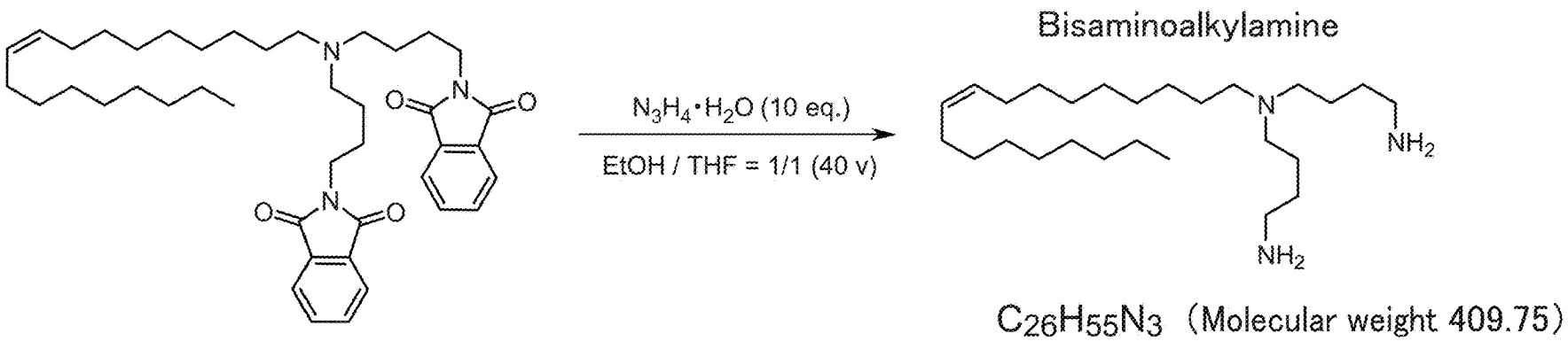
FIG. 1B is an explanatory diagram illustrating the subsequent second synthesis step.

As illustrated in FIGS. 1A and 1B (both figures are collectively referred to as "FIG. 1"), oleylamine ($C_{18}H_{37}N$) was used as a starting material to synthesize bisaminoalkylamine ($C_{26}H_{55}N_3/R=C_{18}H_{35}$, m=n=4) which would be a lubricant. Details are as follows.

First, as illustrated in FIG. 1A, an intermediate bisphthalimide product was generated from oleylamine as follows (first synthesis step). A reaction vessel (300 mL) was charged with oleylamine, N,N-dimethylformamide (DMF dehydrated), phthalimide (N-(4-bromobutyl)phthalimide), and sodium hydrogen carbonate ($NaHCO_3$) under an argon gas atmosphere, and they were stirred into a suspended state. The suspended mixture was heated to 100° C. and stirred overnight in the heated state to complete the reaction.

The reaction liquid was naturally cooled to room temperature, to which city water (1 L) and ethyl acetate (AcOEt: 1 L) were added for dilution. After removing the aqueous layer by liquid separation, the organic layer was separated and washed with city water (0.5 L) and saturated saline (0.5 L). The organic layer was dried by adding $Na_2SO_4$. The filtrate obtained by filtering off the drying agent was concentrated to obtain a crude product (24 g). The crude product was column-purified ($SiO_2$: 480 g, Toluene/Acetone=4/1) to obtain a pale yellow oily bisphthalimide product (14.2 g).

Then, as illustrated in FIG. 1B, bisaminoalkylamine was generated from the bisphthalimide product as follows (second synthesis step). A reaction vessel (1 L) was charged with the bisphthalimide product, tetrahydrofuran (THF), and ethanol (EtOH) under an argon gas atmosphere, and they were stirred to form a uniform solution. Hydrazine hydrate ($N_2H_4H_2O$) was added to this solution, and the mixture was stirred overnight under heat and reflux. Then, after confirming disappearance of the bisphthalimide product by thin layer chromatography (TLC), the reaction was concluded. A solid precipitated from the reaction liquid naturally cooled to room temperature was separated by filtration. The filtrate thus obtained was concentrated to obtain a crude product (11.6 g). This crude product was column-purified ($SiO_2$: 50 g, MeOH only→8M $NH_3$/MeOH) to obtain almost colorless oily bisaminoalkylamine (6.54 g).

(2) Structural Analysis

Figure 2:
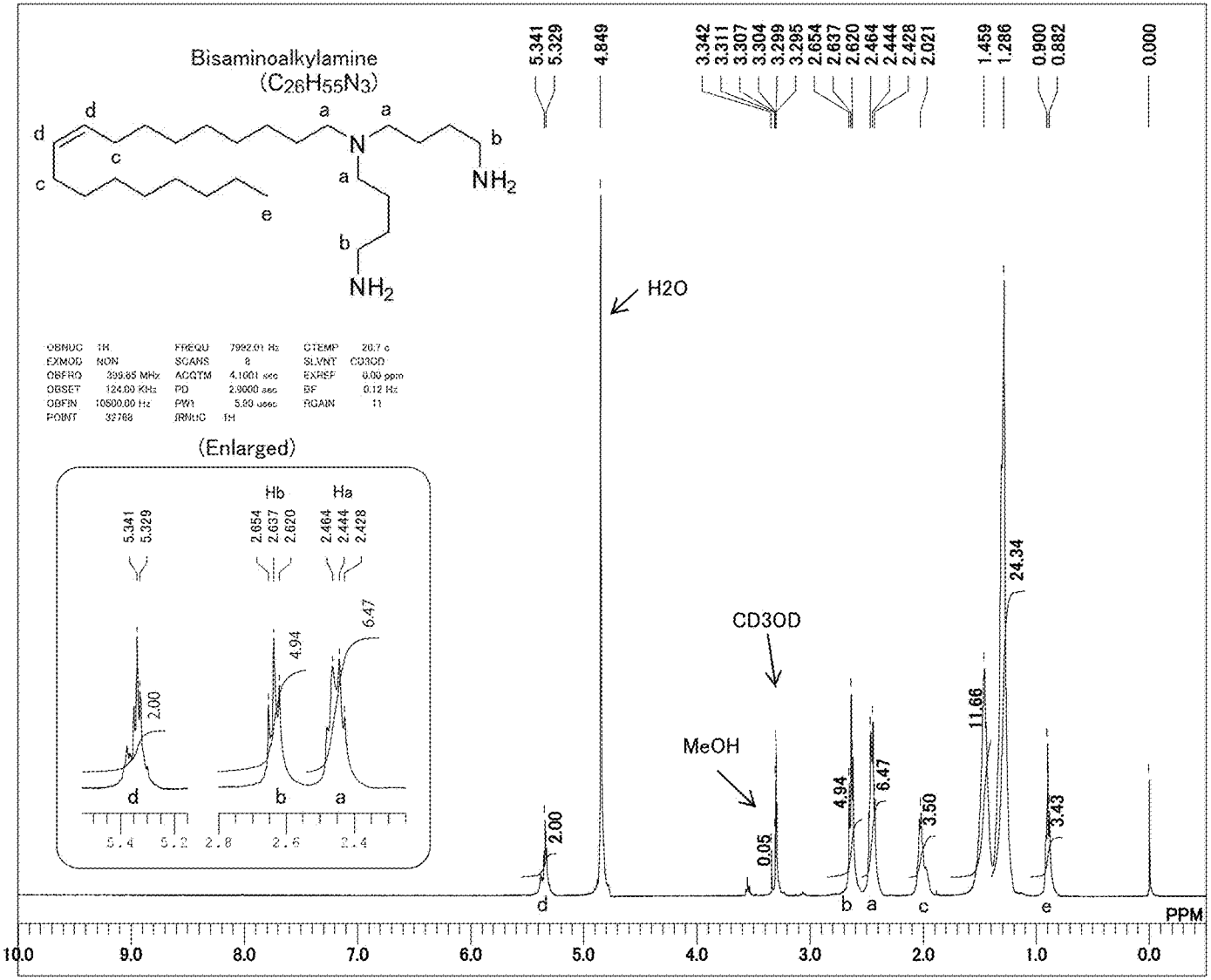
FIG. 2 is a spectrum diagram illustrating an analysis example of the lubricant by $^{1}$H-NMR.

The spectrum obtained by 41-NMR analysis of the synthesized bisaminoalkylamine is illustrated in FIG. 2. Deuterated methanol (CD 3 OD) was used as the solvent. The analysis was carried out at NARD INSTITUTE, LTD. using FT-NMR available from JEOL Ltd. at a measurement frequency of 400 (399.65) MHz.

As is clear from FIG. 2, the hydrogen (Ha) near the nitrogen (N) of the amino group of the main chain (alkylamine) has a peak around 2.4 ppm, and the hydrogen ($H_b$) near the two nitrogen (N) has a peak around 2.6 ppm.

«Verification»

The sliding characteristics when using the synthesized bisaminoalkylamine (bisaminobutyl substitution product) were verified by the following wear test.

(1) Lubricating Oil

The bisaminoalkylamine was compounded at a rate of 0.04 mol/kg with a hydrocarbon-based base oil (Group III base oil/YUBASE2 available from SK Lubricants) to prepare a lubricating oil (Sample 1). For comparison, another lubricating oil was also prepared in which oleylamine was compounded in the same manner as substitute for bisaminoalkylamine (Sample $C_1$).

(2) Wear Test

Figure 3:
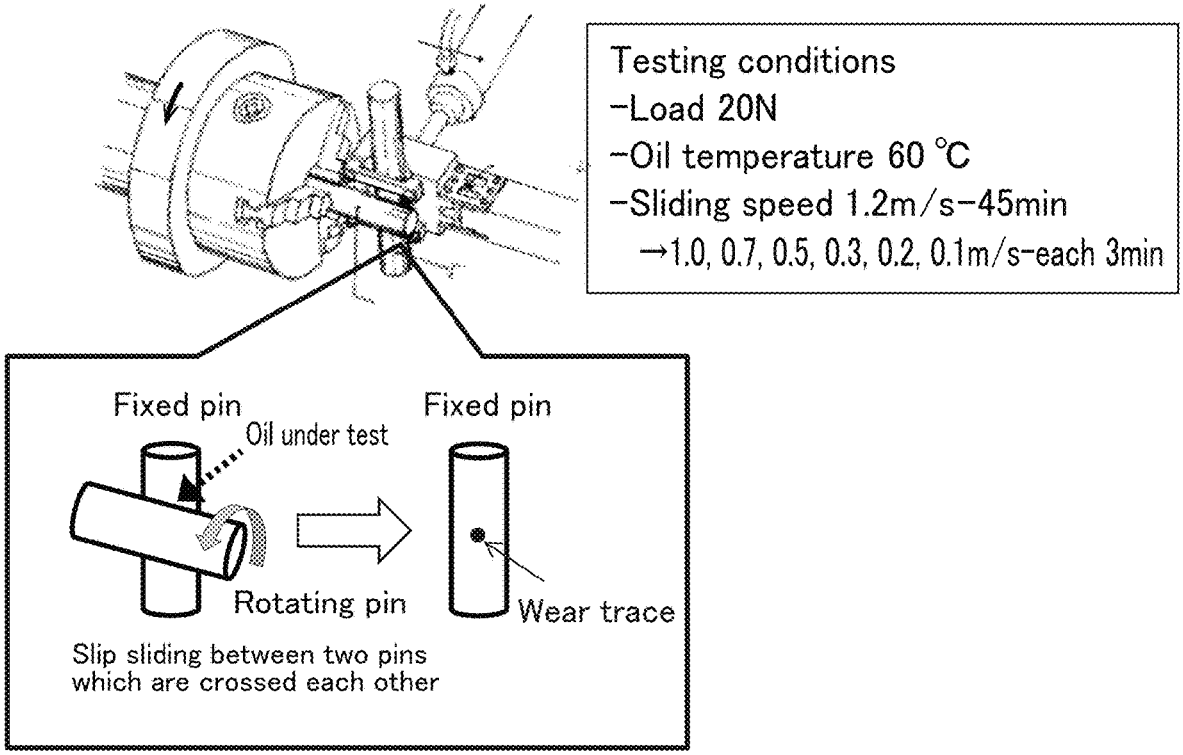
FIG. 3 is a schematic diagram of a cross-pin wear test.

Using the lubricating oil (oil under test) of each sample, the cross-pin wear test illustrated in FIG. 3 was conducted. This wear test was performed by pressing a pin orthogonally against a rotating pin so that they crossed each other. Both pins are made of cylindrical steel materials (φ20 mm) (SCM420), and their surfaces are carburized. The pins have a total length of 150 mm, but the central portions (10 mm in length) used for analysis are of a split type (exchangeable type).

After both pins were held at a sliding speed of 1.2 m/s for 45 minutes with a pressing load between the pins: 20 N, the sliding speed was decelerated in descending order of 1.0 m/s, 0.7 m/s, 0.5 m/s, 0.3 m/s, 0.2 m/s, and 0.1 m/s. After the start of deceleration, the holding time for each sliding speed was 3 minutes. Lubricating oil was supplied to the sliding portions at about 5 mL/min by a rotary pump. To confirm reproducibility, the same test was repeated three times for each sample. Unless otherwise stated, the average value obtained from the three tests was used to evaluate the sliding characteristics of each sample.

(3) Insulation Properties

A voltage (50 mV) was applied between both pins, and the voltage value changed due to an insulating film generated between the pins was measured. The change in voltage value during the test was converted into an insulation ratio (%) and illustrated in FIG. 4. The insulation ratio refers to a variation rate $\{100\times(r-r_0)/r_0\}$ with respect to the electric resistance value (initial value: $r_0$) before the start of test (before rotation).

Figure 4:
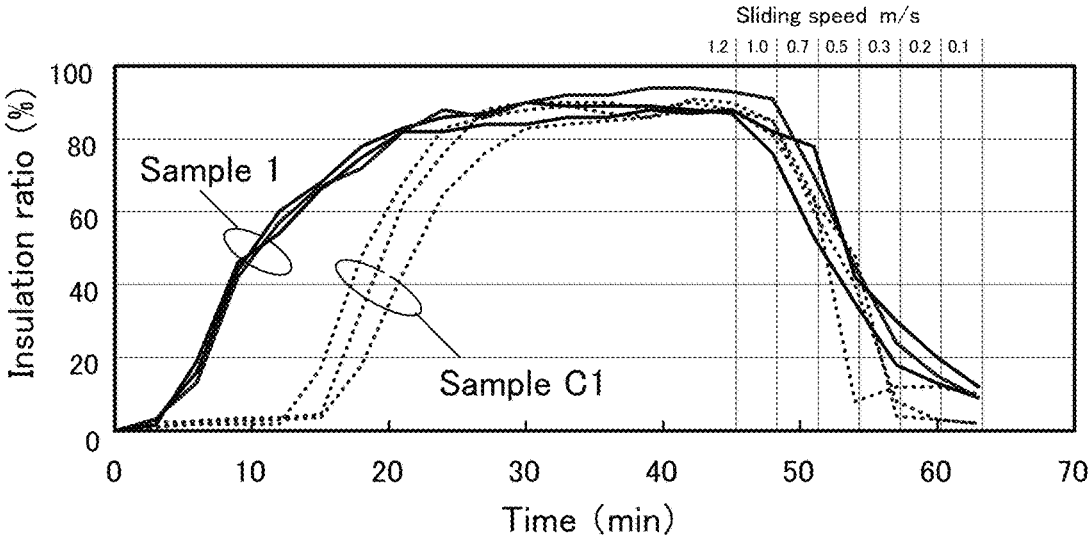
FIG. 4 is a graph illustrating the relationship between an insulation ratio and time obtained by the wear test.

As is clear from FIG. 4, when the lubricating oil (Sample 1) containing bisaminoalkylamine was supplied to the sliding portions, the insulation ratio increased sharply immediately after the start of wear test. On the other hand, when the lubricating oil (Sample C1) containing oleylamine was supplied to the sliding portions, the insulation ratio increased eventually after 15 minutes or more from the start of test.

In the case of Sample 1, it is conceivable that the insulating films (organic films) were quickly adsorbed and formed on the sliding surfaces. As the sliding speed decelerates, the films formed on the sliding surfaces become thinner to increase the shared load so that the detachment (delamination) is likely to occur. It is therefore conceivable that the insulation ratio decreased as the sliding speed decelerated. However, Sample 1 had a slower decrease in the insulation ratio than Sample C1, and a considerable insulation ratio was maintained even in the region in which the sliding speed was 0.5 m/s or less. In other words, it has been found that by using the lubricating oil of Sample 1, the organic films are quickly and stably formed on the sliding surfaces.

(4) Wear Traces

Figure 5A:
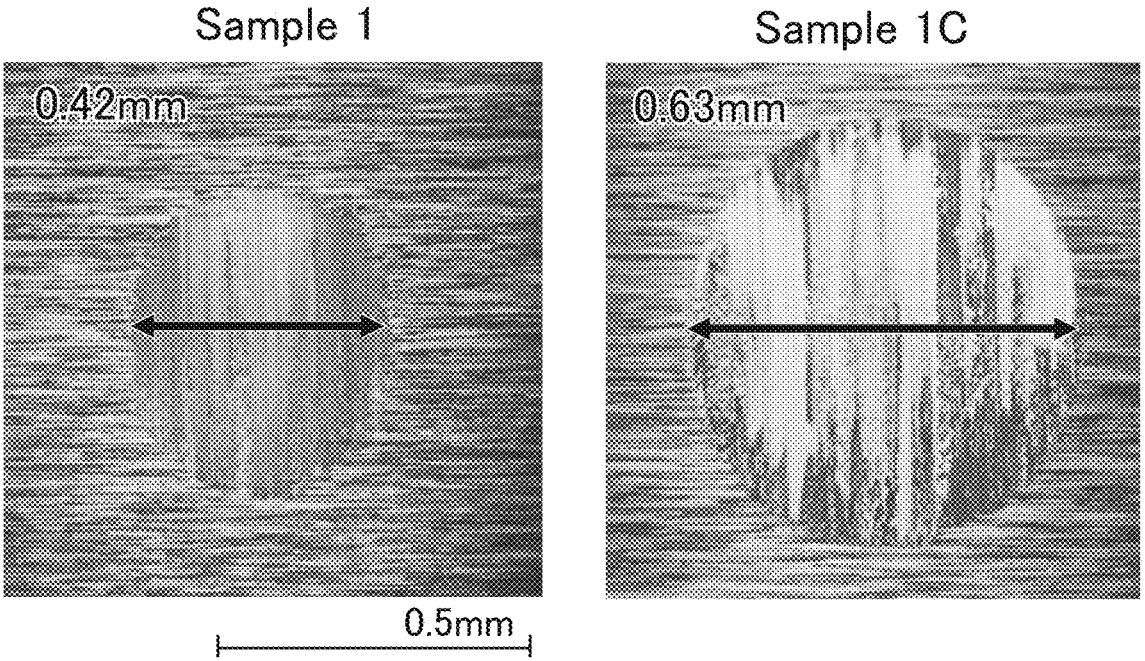
FIG. 5A is a set of photographs showing wear traces obtained by the wear test.
Figure 5B:
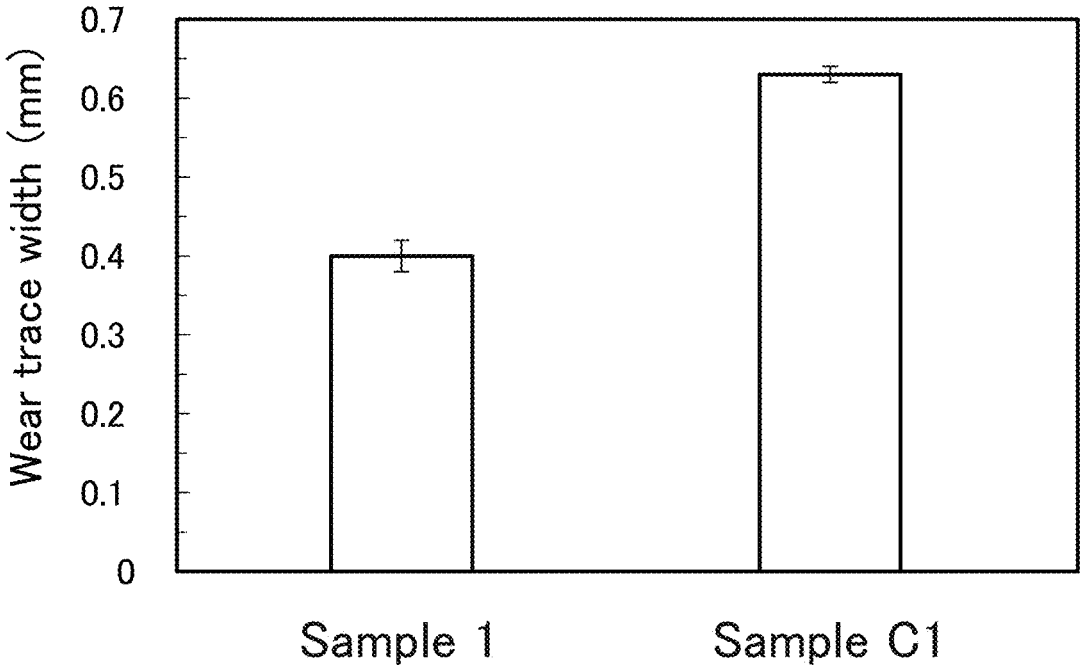
FIG. 5B is a bar graph illustrating the wear trace width.

A photograph of the external appearance of a wear trace (one example) on each fixed pin side after the wear test is shown in FIG. 5A, and each wear trace width (average of three values) is illustrated in FIG. 5B. The wear trace width is the maximum length of the wear trace formed on the surface of the fixed pin in the lateral direction (longitudinal direction of the rotating pin).

As is clear from FIGS. 5A and 5B (both figures are collectively referred to as "FIG. 5"), Sample 1 had a smaller wear trace and less surface roughness than Sample C1.

The area of the wear trace on Sample 1 was approximately half or less that of the wear trace on Sample C1. It is thus conceivable that the substantial pressure acting between the sliding surfaces was greater in Sample 1 than in Sample C1. It has also been found that the lubricant of Sample 1 allows the organic films to be stably formed on the sliding surfaces even under such a high surface pressure.

(5) Adsorption Films

The surface of each wear trace after the cross-pin test was analyzed with a TOF-SIMS apparatus (Time-of-Flight Secondary Ion Mass Spectrometry/TRIFT V nanoTOF available from ULVAC-PHI, Inc.). In this analysis, the central portion of each wear trace was analyzed in a high mass resolution measurement mode using $Bi_3^{++}$ as the primary ion species. The analysis area for Sample 1 having a smaller wear trace was set to 250 μm×250 μm, and the analysis area for sample C1 having a larger wear trace was set to 300 μm×300 μm.

Figure 6:
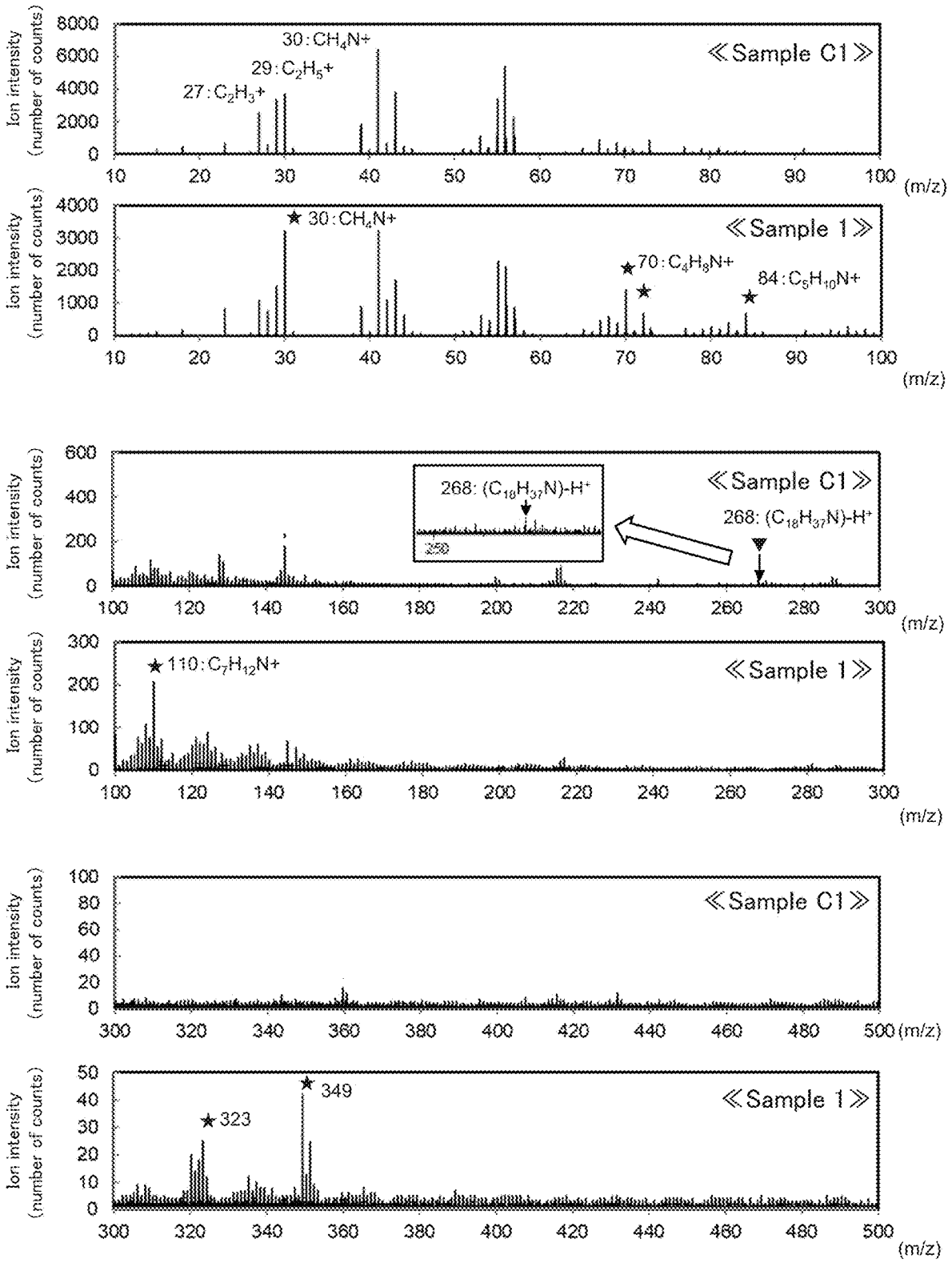
FIG. 6 is a set of spectrum diagrams illustrating analysis examples of wear trace surfaces by TOF-SIMS.

The positive ion spectra of each sample thus obtained are collectively illustrated in FIG. 6. The vertical axis scale of the spectra illustrated in FIG. 6 was adjusted based on the ion intensity of hydrocarbon ions ($C_2H_5$+).

The secondary ion intensity ratios ($S/S_0$) each obtained by normalizing a peak area (S) of a representative fragment with a peak area ($S_0$/reference area) of a reference fragment are collectively illustrated in FIG. 7. Hydrocarbon groups were focused on as representative fragments suitable for quantitative analysis because the hydrocarbon groups are less likely to depend on additives in the oil itself and can be detected over a wide range.

In addition to the peak area around m/z 29.04 ($C_2H_5$+), the peak area around m/z 27.02 ($C_2H_3^+$) and the total ion amount (sum of all peak areas) were adopted for the reference area ($S_0$). FIG. 7 illustrates the normalized secondary ion intensity ratios both in tabular forms and as bar graphs. Each peak area was calculated using analysis software attached to the TOF-SIMS apparatus.

As is clear from FIGS. 6 and 7, at least the peak area ($S_1$) around m/z 30.03 ($CH_4N^+$), the peak area ($S_2$) around m/z 70.07 ($C_4H_8N^+$), and the peak area ($S_3$) around m/z 84.08 of Sample 1 were larger than those of Sample C1. In terms of the intensity ratio based on the peak area ($S_0$) around m/z 29.04 ($C_2H_5$+), $S_1/S_0$, ≈2.43 (≥1.5), $S_2/S_0$≈1.67 (≥0.3), and $S_3/S_0$, ≈0.89 (≥0.1) were obtained in the case of Sample 1. On the other hand, in the case of Sample C1, $S_2/S_0$, ≈0.21, and $S_3/S_0$, ≈0.095 were obtained. These were significantly smaller than those of Sample 1.

In Sample 1, a group of characteristic peaks that were not observed in Sample C1 also appeared around m/z 110 ($C_7H_{12}N^+$), around m/z 323.32, and around m/z 349.35.

It is conceivable that adsorption films derived from organic components exhibiting such secondary ion peaks were formed on the base material surfaces (sliding surfaces) thereby to develop the excellent adsorptivity and sliding characteristics (such as wear resistance).

«Additional Notes»

With consideration for the above-described results, the alkyl chain lengths (m and n in the chemical structural formula (1)) of bisaminoalkylamine are studied by a molecular dynamics method using molecular calculation software (Materials Studio/Forcite Plus available from Dassault Systemes).

Figure 8:
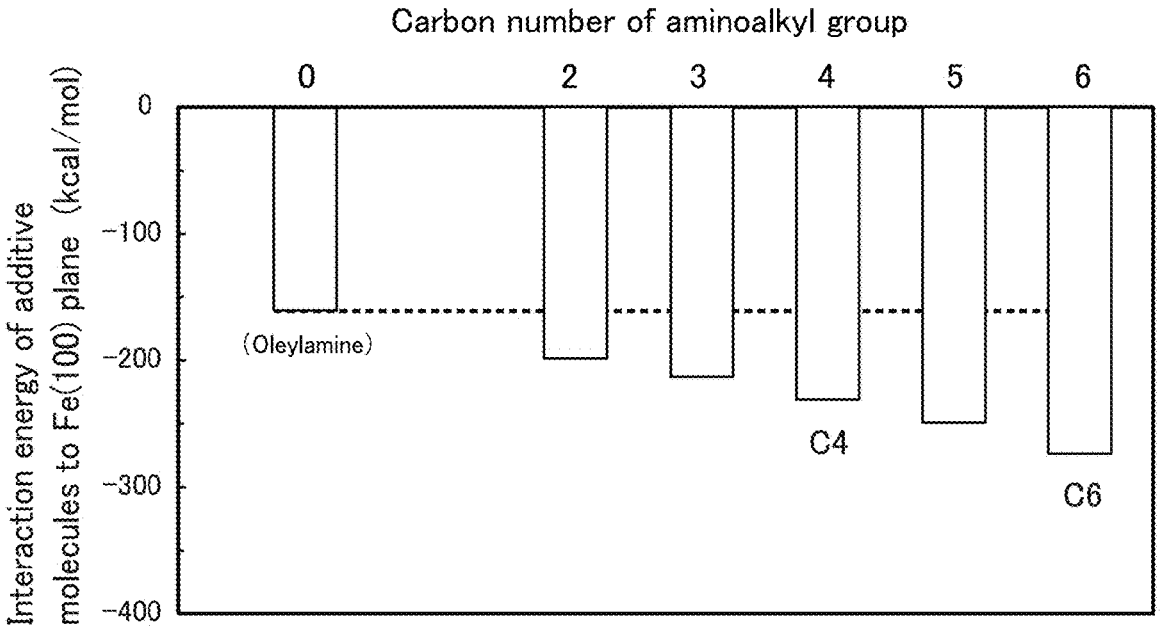
FIG. 8 is a bar graph illustrating the relationship between the carbon number of an aminoalkyl group in additive molecules and the interaction energy of the additive molecules to an Fe(100) plane.

As illustrated in FIG. 8, it has been found that the longer the alkyl chain length of the bis(aminoalkyl) group the molecule has, the larger on the negative side the interaction energy to the metal surface (Fe(100) plane) (i.e., the more stably the molecule adsorbs to the metal surface).

Unfortunately, however, a molecule having an unduly long chain length is likely to cause steric hindrance when added to a base oil, and it is expected that the adsorptivity to the surface of a base material will deteriorate. Accordingly, the adsorptivity of each molecule in a mixed system with a base oil is evaluated by Amorphous Cell calculation using the above-described molecular calculation software.

Figure 9:
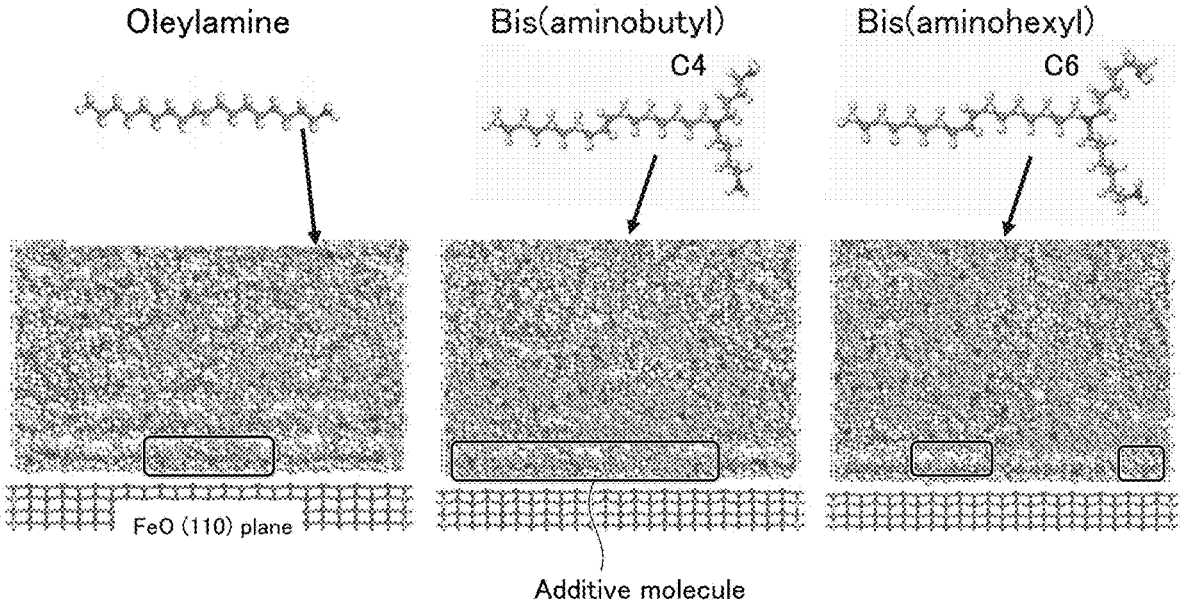
FIG. 9 is a set of model diagrams exemplifying the adsorptivity of the additive molecules to the FeO(110) plane.

For mixed systems (density: 0.8 g/cm 3) each composed of 80 molecules of an additive and 120 molecules of a base oil (isododecane), the situations after 10 ns has passed after contact with the surface of a base material are illustrated in FIG. 9. Focusing on the vicinity of the base material surface (FeO(110) plane), it has been confirmed that when the carbon number in the alkyl chain length of the bis(aminoalkyl) group is 4 ($C_4$), the adsorption ratio of the additive molecules to the base material surface (sliding surface) is higher than that when the carbon number is 6 ($C_6$) or 0 (oleylamine). From these results, it can be said that the carbon number (m, n) in the alkyl chain length is preferably around 4, that is, about 2 to 8 in an embodiment or about 3 to 6 in another embodiment. Note that m and n may be different integers, but the synthesis of the additive (lubricant) may be easy when they are the same integer.

The invention claimed is:

1. A lubricant composition comprised of a lubricant represented by a chemical structural Formula (2) below:

Formula (2)

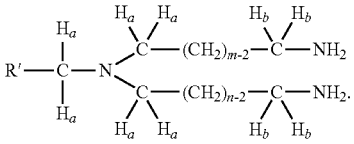

2. A sliding machine having a metal surface to which the lubricant composition according to claim 1 is supplied.

3. The sliding machine according to claim 2, wherein an organic film is present on the metal surface, wherein when positive ion spectrum analysis is performed with time-of-flight secondary ion mass spectrometry (TOF-SIMS), the organic film satisfies conditions below with reference to a reference area that is a peak area ($S_0$) around m/z 29.04 ($C_2H_5^+$):

a peak area ($S_1$) around m/z 30.03 ($CH_4N^+$) is 1.5 times or more the reference area ($S_1/S_0$≥1.5);

a peak area ($S_2$) around m/z 70.07 ($C_4H_8N^+$) is 0.3 times or more the reference area ($S_2/S_0$≥0.3); and a peak area ($S_3$) around m/z 84.08 ($C_5H_{10}N^+$) is 0.1 times or more the reference area ($S_3/S_0$≥0.1).

4. The sliding machine according to claim 3, wherein the organic film further satisfies a condition that a peak area (S 4) around m/z 323.32 is 0.01 times or more the reference area (S 4/$S_0$≥0.01).

5. The sliding machine according to claim 3, wherein the organic film further satisfies a condition that a peak area (S 5) around m/z 349.35 is 0.01 times or more the reference area (S 5/$S_0$≥0.01).

6. The lubricant composition according to claim 1, wherein in Formula (2), m and n are both 4.

* * * * *